United States Patent [19]

Andersson et al.

[11] 4,289,363

[45] Sep. 15, 1981

[54] LOCKER CONSTRUCTION AND MULTIPLE ARRANGEMENT THEREOF

[75] Inventors: Olof I. Andersson; Jan O. Kullander, both of Säffle, Sweden

[73] Assignee: Aktiebolaget Electrolux, Stockholm, Sweden

[21] Appl. No.: 93,757

[22] Filed: Nov. 13, 1979

[30] Foreign Application Priority Data

Apr. 9, 1979 [SE] Sweden ..... 7903118

[51] Int. Cl.[3] ..... A47F 5/08

[52] U.S. Cl. ..... 312/257 R; 312/199; 312/263

[58] Field of Search ..... 312/198, 199, 214, 257 R, 312/257 SN, 258, 263

[56] References Cited

U.S. PATENT DOCUMENTS 2,591,172 4/1952 Nundine ..... 312/263
2,651,559 9/1953 O'Connor ..... 312/257 R
3,133,772 5/1964 Braudes et al. ..... 312/263
3,784,271 1/1974 Schreiber ..... 312/257 R

*Primary Examiner*—Casmir A. Nunberg
*Attorney, Agent, or Firm*—Alfred E. Miller

[57] ABSTRACT

A locker having a rear wall, two side walls, and a frame-shaped front wall which are all interconnected to form a box-like structure, which together with a top and bottom part can be shipped disassembled. The locker can be assembled on the site where it is received in reduced amount of time since screws, rivets, soldering joints, and other types of fastening means are avoided. The assembly or locker contemplates the walls having bent portions which can be pivoted and hooked to one another to form a joint and will not separate. In addition, the top and bottom portions of the locker can be held in place by embossments located on the side walls, as well as the rear wall of the locker. In addition, the frame-shaped front wall of the locker is held in place by vertical front edges of each side wall which are U-shaped in cross-section and tightly engage corresponding vertical parts of the frame-shaped front wall.

6 Claims, 3 Drawing Figures

35
16
26
25
27
10
36
28
31
15
22
21
20
19
18
47
30
2
29
45
44
46
11
33
17
37
38
24
13
32
34
39
40
42
41
43
12
14
23

LOCKER CONSTRUCTION AND MULTIPLE ARRANGEMENT THEREOF

BACKGROUND OF THE INVENTION

The present invention relates to a locker, for example, constructed of sheet metal and which includes a rear wall and two side walls. The rear wall and the two side walls are provided with adjacent bent edges which interconnect and lock the walls together, a frame-shaped front wall is joined to the side walls by side edge portions which also snap-over the adjacent edges of the side walls to form an elongated box-like structure. Thus, the vertical edges of the rear wall and the vertical edges of the side walls which are adjacent thereto have bent portions which engage upon pivoting of the respective wall portions relative to one another to form a joint to prevent separation of the walls. The locker is also provided with a top part and a bottom part, and in some cases also a door mounted in the front wall section. The vertical edge of each side wall is U-shaped in cross-section in order to receive the vertical elements of said front wall.

Lockers of the above-described type are preferably used for storing work clothes or sport equipment, and the present locker is shipped knocked down so that transportation costs are low, and the various parts can be assembled in situ.

However, in practice it is known that there are difficulties in securing the front wall safely to the side walls of an assembly, and, even if the parts of the locker are joined generally without screws, rivets or by soldering. Such joints are necessary in order to attach certain other parts to the locker. For this reason, assembly is comparatively time consuming, and the object of the present invention is to secure the front wall, and other parts of the locker in a simple manner completely without any joint of the above type. The above objective is achieved by practicing the present invention in accordance with the teachings set forth hereinafter.

In order that the invention will be more clearly understood, it will now be disclosed in greater detail with reference to the accompanying drawings, in which.

DESCRIPTION OF THE PREFERRED EMBODIMENT

Figure 1:
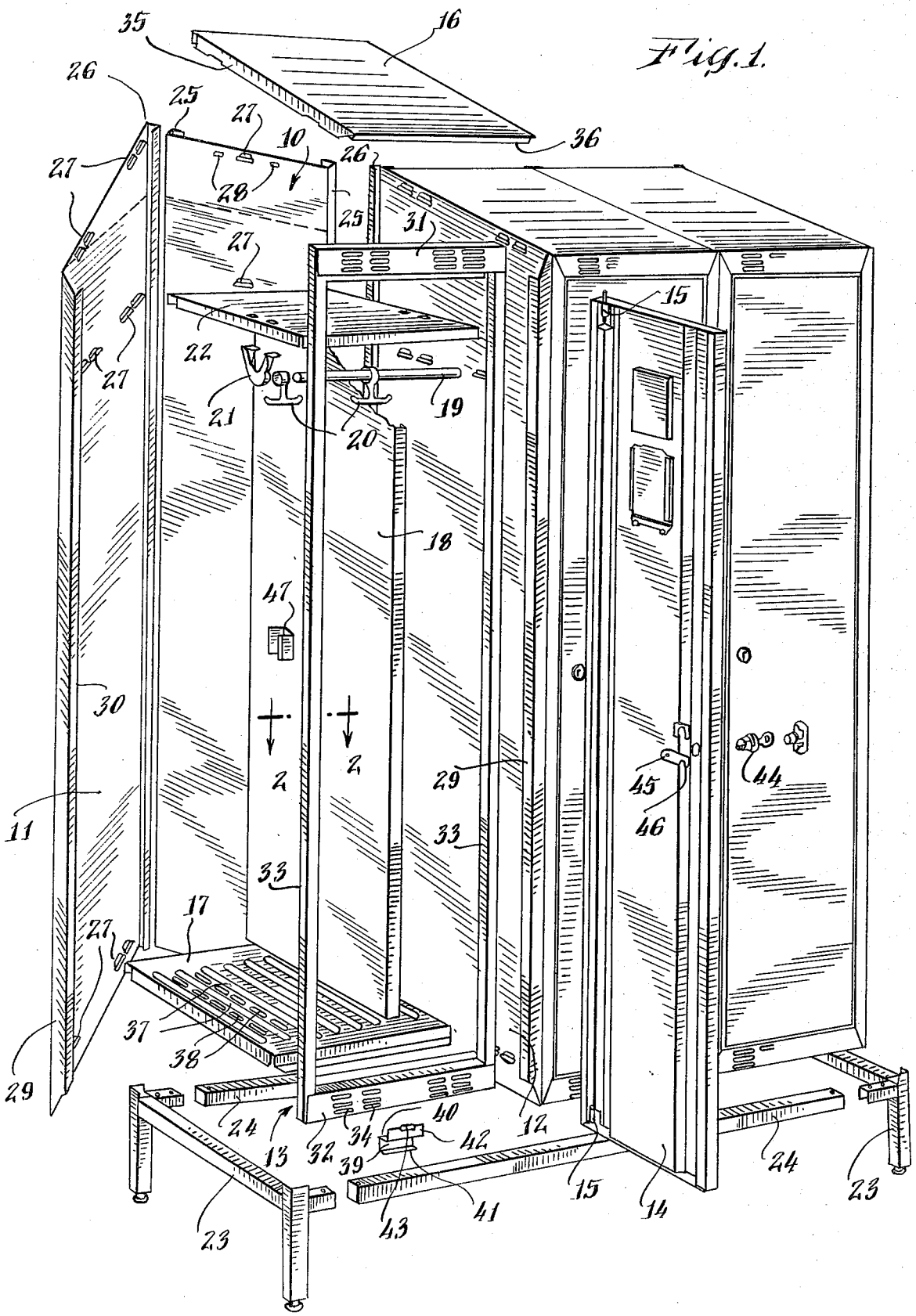
FIG. 1 is an exploded perspective view of the invention in detail with respect to one of the lockers, while the other two gang lockers show the invention in which a multiplicity of lockers in alignment are utilized.

Referring to FIG. 1, the locker constructed in accordance with the teachings of the present invention comprises a wall 10 and two side walls 11 and 12 and a frame-shaped wall 13. In the front wall, a door 14 is suspended on two hinges 15. The locker is provided with a top part 16 and a bottom part 17, and also fittings in the form of a partition 18, clothes rod 19 with hooks 20, brackets 21 for the rod and a shelf 22. The locker rests on a support comprising stands 23 which are held together by square section pipes 24.

If desired, the side walls can be made so as to form a partition between two adjacent lockers as seen in FIG. 1.

The rear wall 10 is provided with vertical edges 25 which are bent such that after turning of the rear wall relative to the side walls 11 and 12, the edges engage with bent cover rear vertical edges 26 of the side walls, so that a joint is formed between the walls. Furthermore, the rear wall has struck out portions or embossings 27 extending toward the interior of the locker which are provided from the top and bottom parts 16 and 17 respectively, and for the shelf 22. The rear wall and its upper and lower parts has embossed lugs 28 which are bent inward for securing the top and bottom parts thereof.

Each side has a U-shaped vertical front edge 29 with a bent portion 30 which is meant to retain the front wall 13.

The front wall 13 includes an upper and lower horizontal grille portions and two vertical parts 33 connected to these grille portions. Each part 33 comprises a U-shaped open section of iron intended to be inserted from the interior of the locker in a U-shaped edge 29 so that one leg abuts the side wall, and the other leg on assembly falls in between the free end of the bent portion 30 in the bottom of the U-shaped edge 29. In this way, the side wall is locked to the front wall and each upper and lower horizontal portion 31 and 32 respectively, has vent openings 34 through which air can enter into the locker.

The top part 16 of the locker is formed of a sheet metal plate with a portion 35 bent through 90° along the rear and side edges. The rear edge has some openings (not shown) through which the lugs 28 of the rear wall 10 can be inserted and bent to fix the top part to the lower portion of the locker. The front edge 36 of the top part is bent so as to snap around the bent upper edge of the front wall. The top part is mounted in such a manner that the front edge is caused to snap over the edge of the front wall, after which the top is placed on the embossings 27 of the rear wall and is locked by bending of the lugs 28 of the rear wall to snap into the rear edge of the top 16.

The bottom part 17 of the locker is of a form corresponding to that of the top part 16, and is mounted in the same manner. The bottom part 16 has elevated elongated ribs 37 for stiffening purposes, and vent openings 38.

Two clamps 39 function to join the locker to its floor support. The clamps are U-shaped in cross section, having legs 40 and 41 which are slightly converging. One leg 40 merges into another leg 42 bent through 90° and having at its outer end a lug 43 which is bent in the opposite direction. This lug is to be inserted in a rectangular opening (not shown) in the rear wall 10, after which the clamp 39 is fixed to a square-section pipe 24 at the rear of the locker. The front part of the locker is fixed to the floor support by an inwardly-directed flange of the horizontal lower portion 32 of the front wall being clamped between the two legs 40 and 41 of the clamp.

Figure 2:
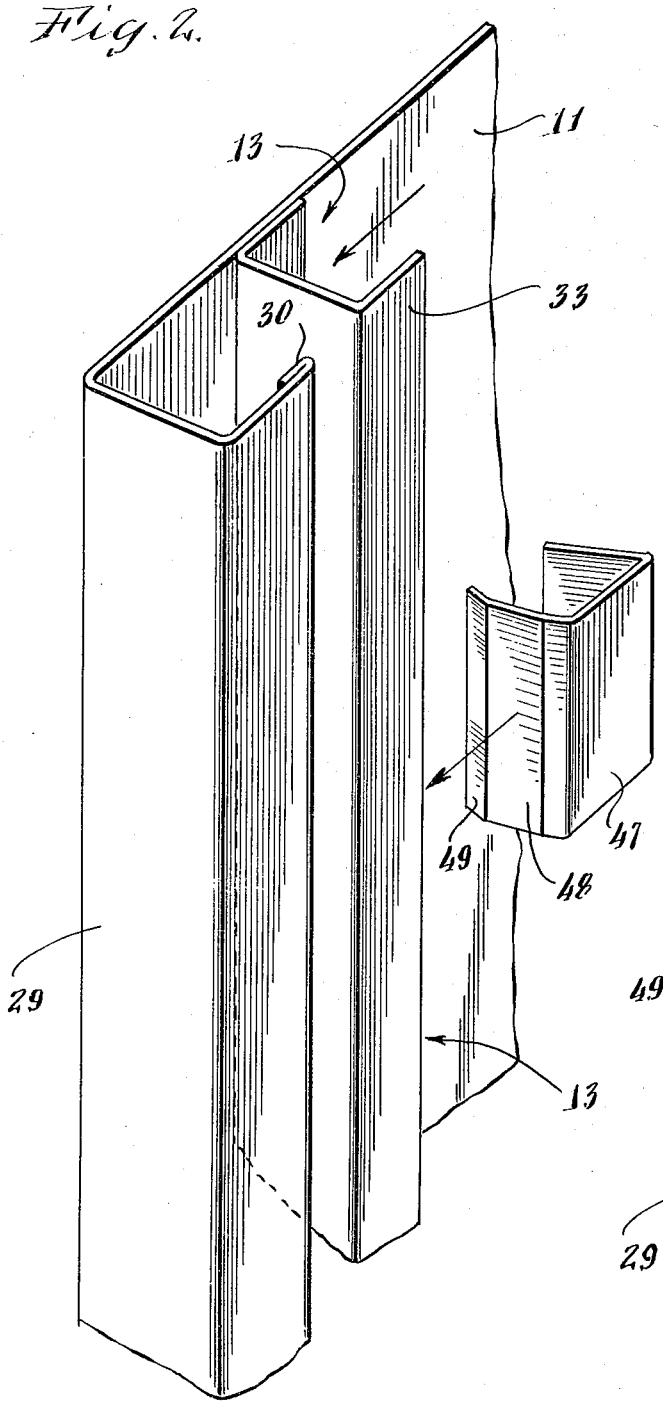
FIG. 2 is a sectional view taken on the plane 2—2 of FIG. 1, showing the parts ready for assembly.
Figure 3:
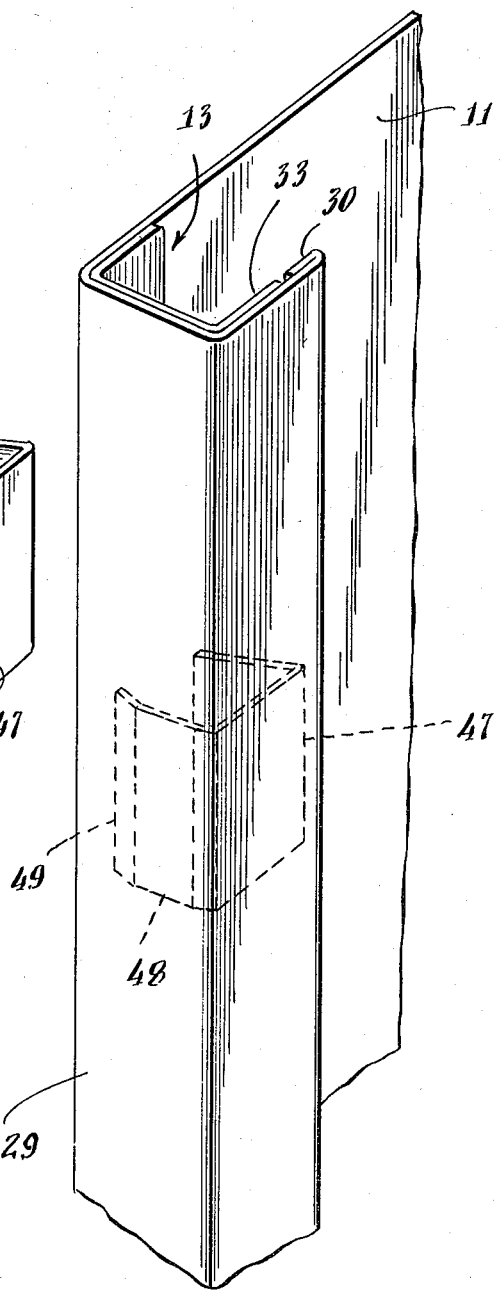
FIG. 3 is a sectional view similar to FIG. 2 showing the parts in assembled position.

The door 14 has a lock comprising a bolt 45 with a recess 46 in its bottom. The recess coacts with a holder 47 which makes it difficult to break into the locker. The holder 47, as seen in FIGS. 2 and 3, consists of a generally U-shaped open section part with a leg 48 somewhat inclined towards the inner portion of the part and with its outer portion 49 bent further inwards. Because of this special shape the holder 47 can be clamped into the U-shaped open section part 33 of one of the vertical parts of the front wall 13 and into the edge portion of the corresponding side wall. The bottom of the U-shaped open section part extends a little beyond the edge portion, to thereby permit the cut 46 of the bolt 45 to latch on to the holder 47.

The invention is, of course, not limited to the embodiment shown, but can be modified within the spirit and scope of the following claims.

What is claimed is:

1. A locker having a rear wall, two side walls, and a frame-shaped front wall which are all interconnected to form a box-like structure, the adjacent vertical edges of said rear and side walls having bent portions which upon abutment and pivoting hook one another to form a joint which prevents separation of said side walls and rear wall, said locker additionally comprising a generally rectangular top part and bottom part, the vertical front edges of each side wall being U-shaped in cross-section in order to tightly engage the respective vertical portions of said frame-shaped front wall, and one leg of each of said vertical front edges having a return bent part of said bent portion that functions to retain said frame-shaped front wall in its assembled condition.

2. A locker as claimed in claim 1 further comprising a door, and means for mounting said door flush within said frame-shaped front wall.

3. A locker as claimed in claim 1 wherein the cross-sectional area between the free end of each of said bent portions and the corresponding bottom of the U-shaped portion of said vertical front edges is slightly greater than the thickness of the corresponding vertical portions of said frame-shaped front wall.

4. A locker as claimed in claim 1 wherein said top part is provided with a bent front edge that is adapted to tightly engage the upper front horizontal portion of said frame-shaped front wall, said rear and side walls having inwardly-directed and spaced embossings, said top part having downwardly directed edge portions on the sides and rear thereof which are supported by said embossings, and said downwardly directed rear edge portions being provided with spaced openings therein through which corresponding embossings on said rear wall project.

5. A locker having a rear wall, two side walls, and a frame-shaped front wall which are all interconnected to form a box-like structure, the adjacent edges of said rear and side walls having bent portions which upon abutment and pivoting hook one another to form a joint which prevents separation of said side walls and rear wall, said locker additionally comprising a generally rectangular top part and bottom part, the vertical front edges of each side wall being U-shaped in cross-section in order to tightly engage the respective vertical portions of said frame-shaped front wall, one leg of each of said vertical front edges having a bent portion that functions to retain said frame-shaped front wall in its assembled condition, a reinforcing part for said frame-shaped front wall, a locking bolt movably mounted on the rear of said door, but operable from the front thereof, said bolt having an open-ended groove therein, one of said vertical parts of said frame-shaped front wall being channel-shaped in cross-section with the open end of said channel facing the space formed by said frame-shaped front wall, said reinforcing part being mounted in said vertical part in operative relationship to said bolt, and said reinforcing part having an open central section and a portion thereof in space-confronting relationship with said bolt whereby the groove of said bolt engages said portion of the reinforcing part in the locked condition of said bolt.

6. A locker as claimed in claim 5 wherein said reinforcing part is channel-shaped and has a leg which is inclined toward the inner portion of said part, said leg being provided with an edge portion that is slightly bent inwardly.

* * * * *